US007942497B1

(12) United States Patent
Matsumoto et al.

(10) Patent No.: US 7,942,497 B1
(45) Date of Patent: May 17, 2011

(54) INK JET RECORDING HEAD

(75) Inventors: Kozo Matsumoto, Tokyo (JP); Toru Nakajima, Tokyo (JP)

(73) Assignee: Hewlett-Packard Development Company, L.P., Houston, TX (US)

( * ) Notice: Subject to any disclaimer, the term of this patent is extended or adjusted under 35 U.S.C. 154(b) by 678 days.

(21) Appl. No.: 10/585,433

(22) PCT Filed: Dec. 27, 2004

(86) PCT No.: PCT/JP2004/019809

§ 371 (c)(1), (2), (4) Date: Aug. 27, 2008

(87) PCT Pub. No.: WO2005/065951

PCT Pub. Date: Jul. 21, 2005

(30) Foreign Application Priority Data

Jan. 7, 2004 (JP) ..... 2004-002211
Feb. 25, 2004 (JP) ..... 2004-049111

(51) Int. Cl.
*B41J 2/155* (2006.01)

(52) U.S. Cl. ..... 347/42; 347/20; 347/40

(58) Field of Classification Search ..... 347/15, 347/20, 40–43, 108, 201, 12, 9, 49, 50, 57
See application file for complete search history.

(56) References Cited

U.S. PATENT DOCUMENTS

| | | | | |
|---|---|---|---|---|
| 5,646,658 | A | 7/1997 | Thiel et al. | |
| 5,782,184 | A | 7/1998 | Albertalli et al. | |
| 7,311,378 | B2 * | 12/2007 | Fujimori et al. | 347/33 |

FOREIGN PATENT DOCUMENTS

| | | | |
|---|---|---|---|
| JP | 55-152066 | | 11/1980 |
| JP | 55-152066 | A | 11/1980 |
| JP | 60-247565 | | 12/1985 |
| JP | 60-247565 | A | 12/1985 |
| JP | 07-081049 | | 3/1995 |
| JP | 2003-89195 | A | 3/2003 |
| JP | 2003 89195 | A | 3/2003 |

OTHER PUBLICATIONS

European Supplementary Search Report for Application No. EP04808159. Report issued Jul. 6, 2009.
Chinese Office Action in Co-pending Chinse Application No. 200480042267.1 dated May 9, 2008.

* cited by examiner

*Primary Examiner* — Thinh H Nguyen

(57) ABSTRACT

An ink jet recording head (100) comprising edge shooter type head units (20) each having a head chip provided with a nozzle ejection surface, a positioning plate (41) for arranging the head units (20) in parallel to each other, inclined against a line arranging direction. The positioning plate (41) arranges the head units (20) in parallel to each other, inclined against the line arranging direction, and the angle of the inclination is set so that a nozzle interval, in the line arranging direction, of two nozzles (21*a*) corresponds to a predetermined resolution, the two nozzles being adjacent to each other on a straight line on the nozzle ejection surface.

8 Claims, 11 Drawing Sheets

【Figure 1】
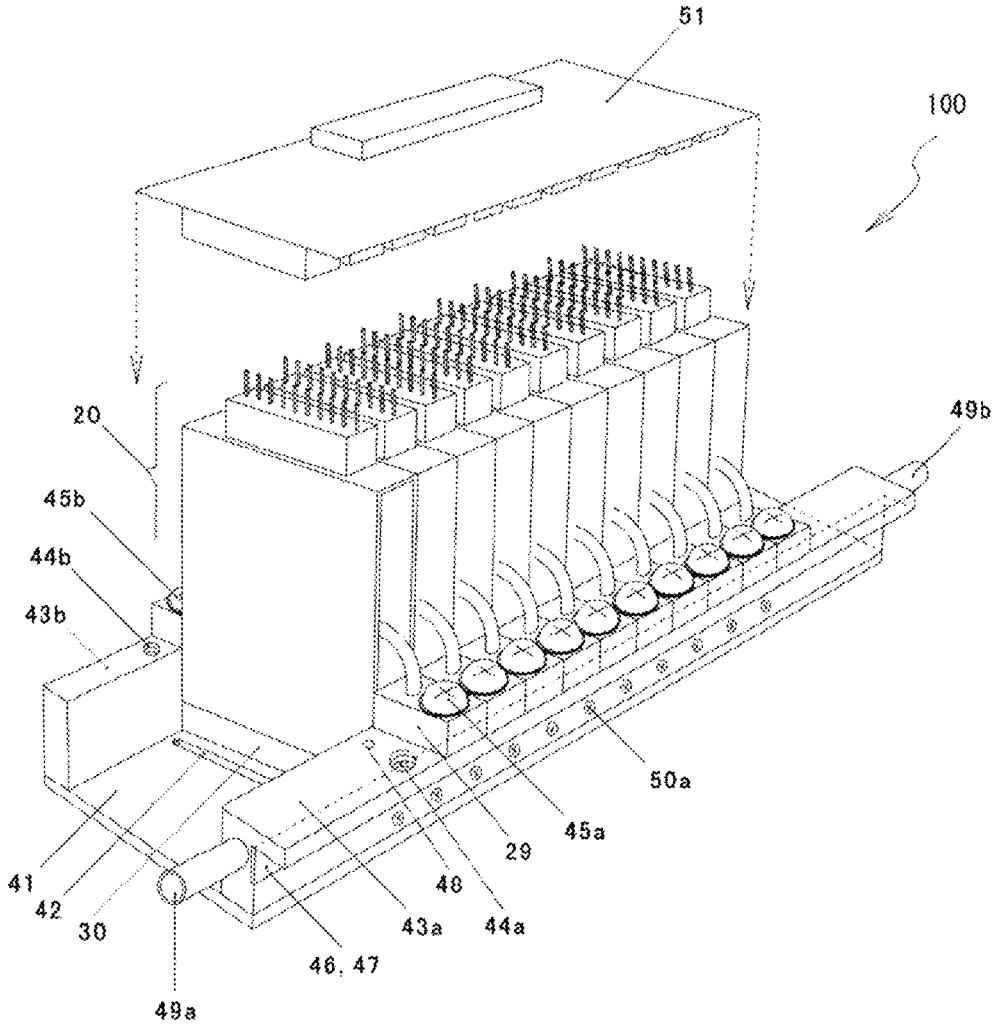

【Figure 2】
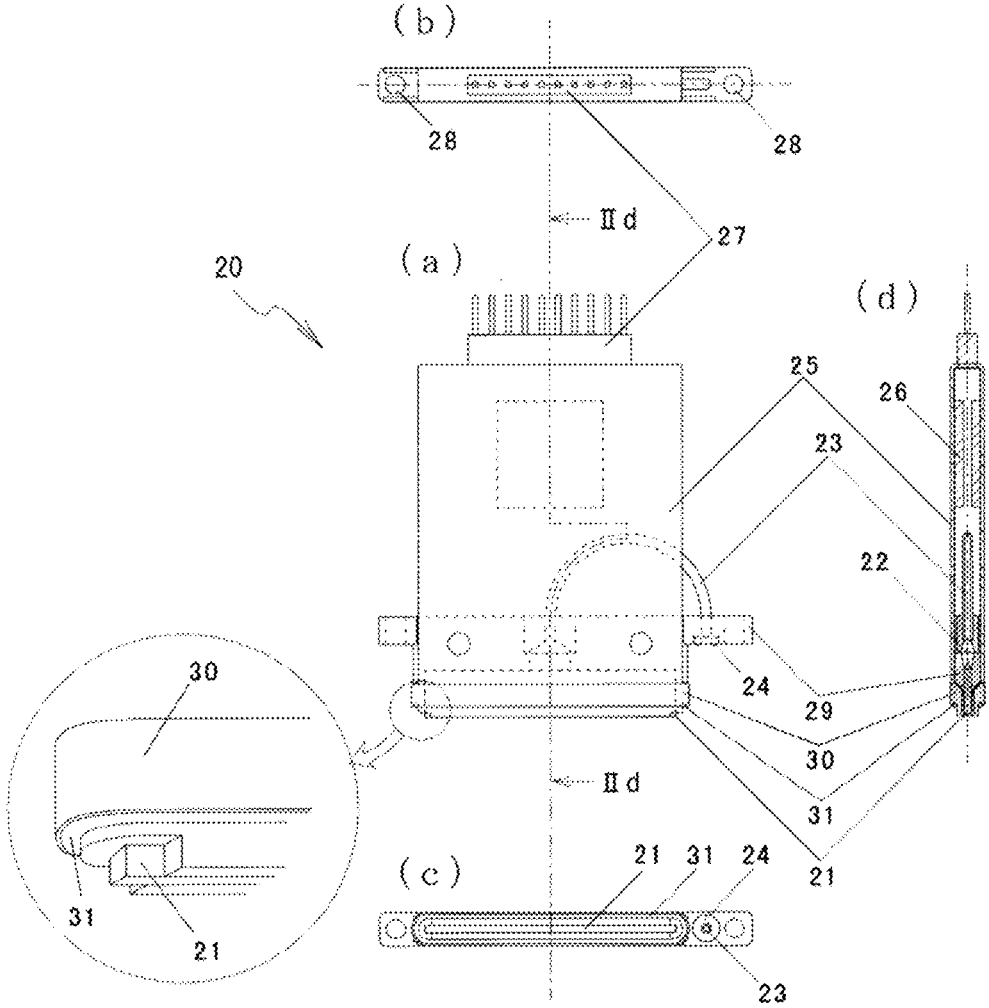

【Figure 3】
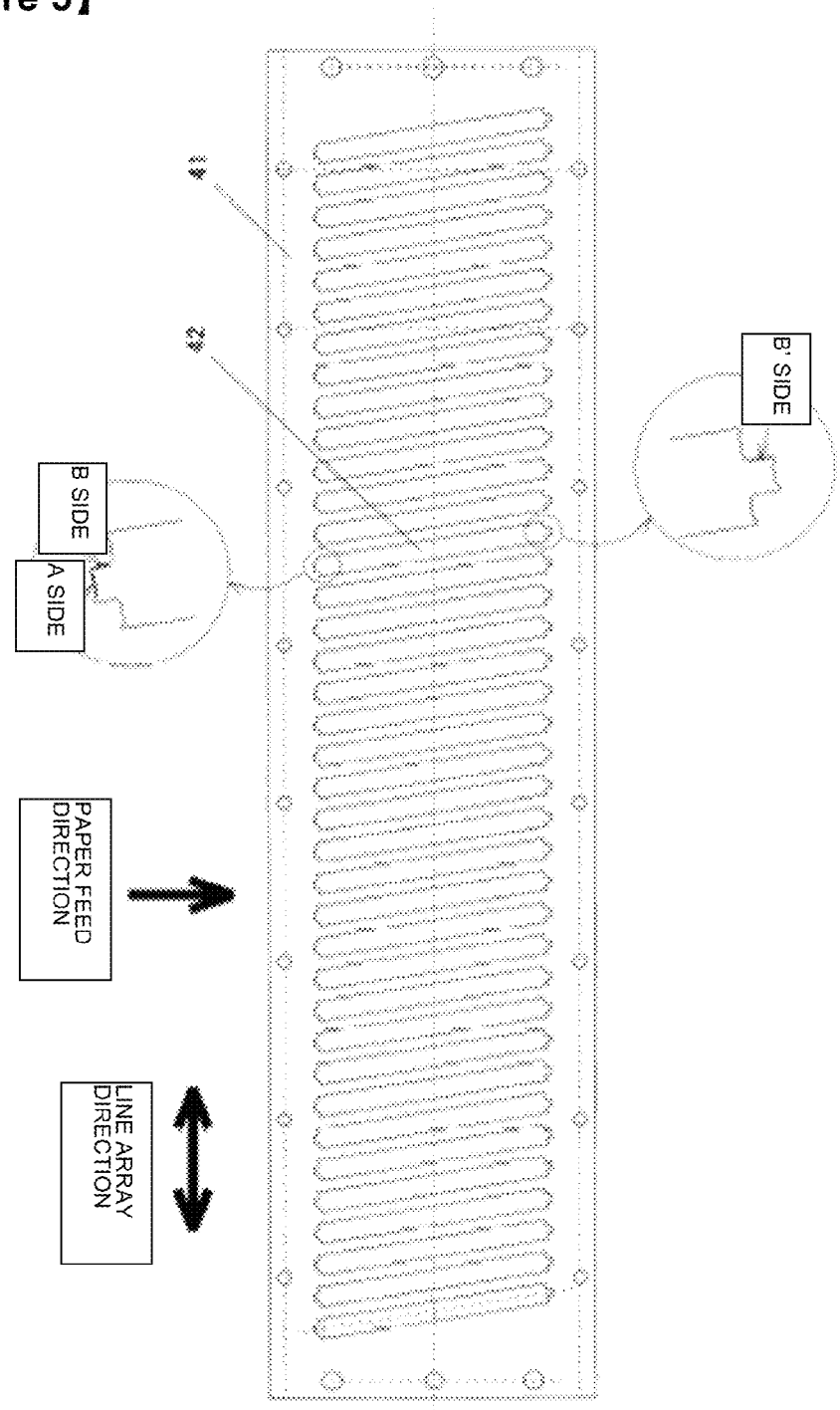

【Figure 4】
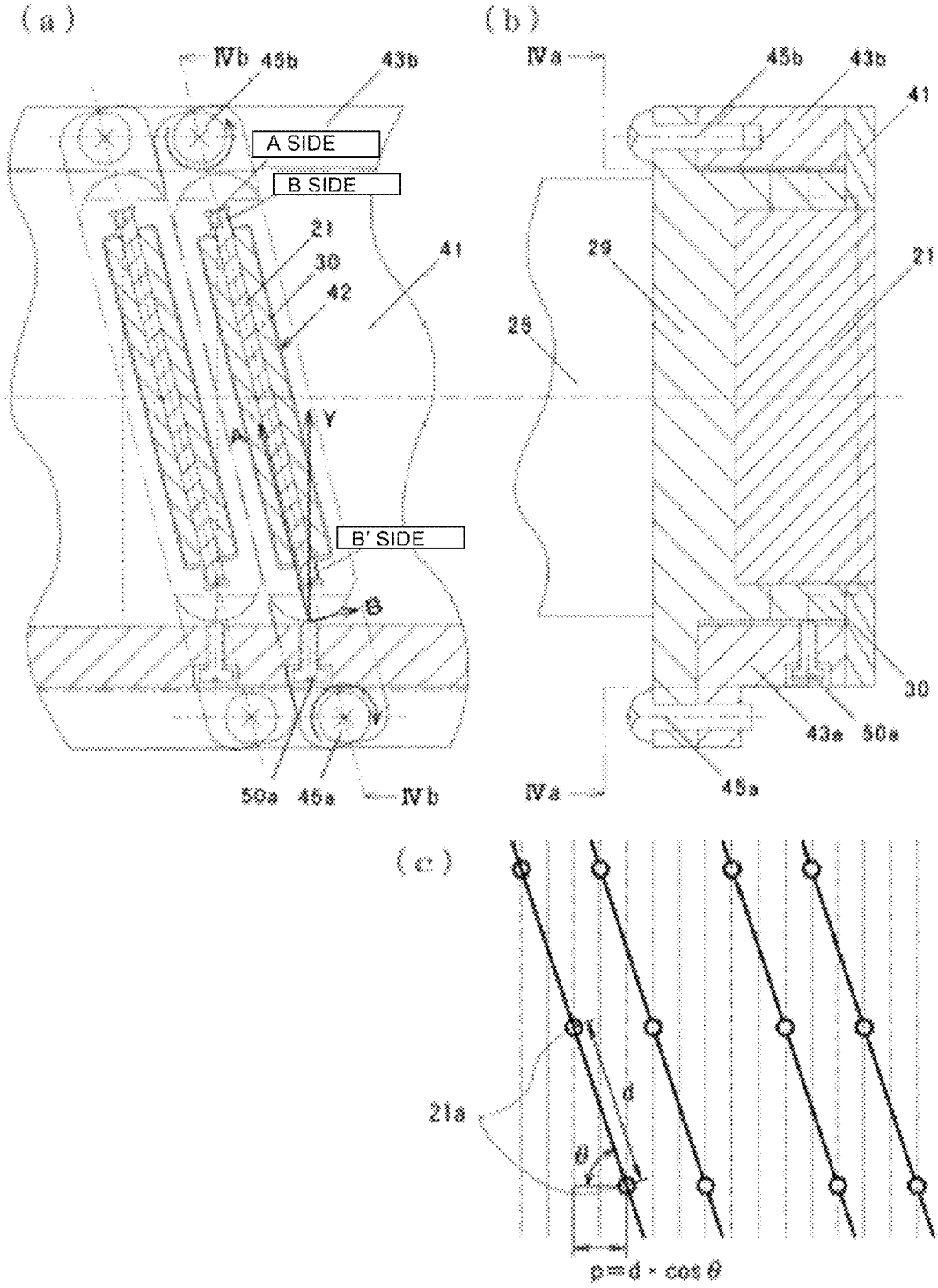

【Figure 5】
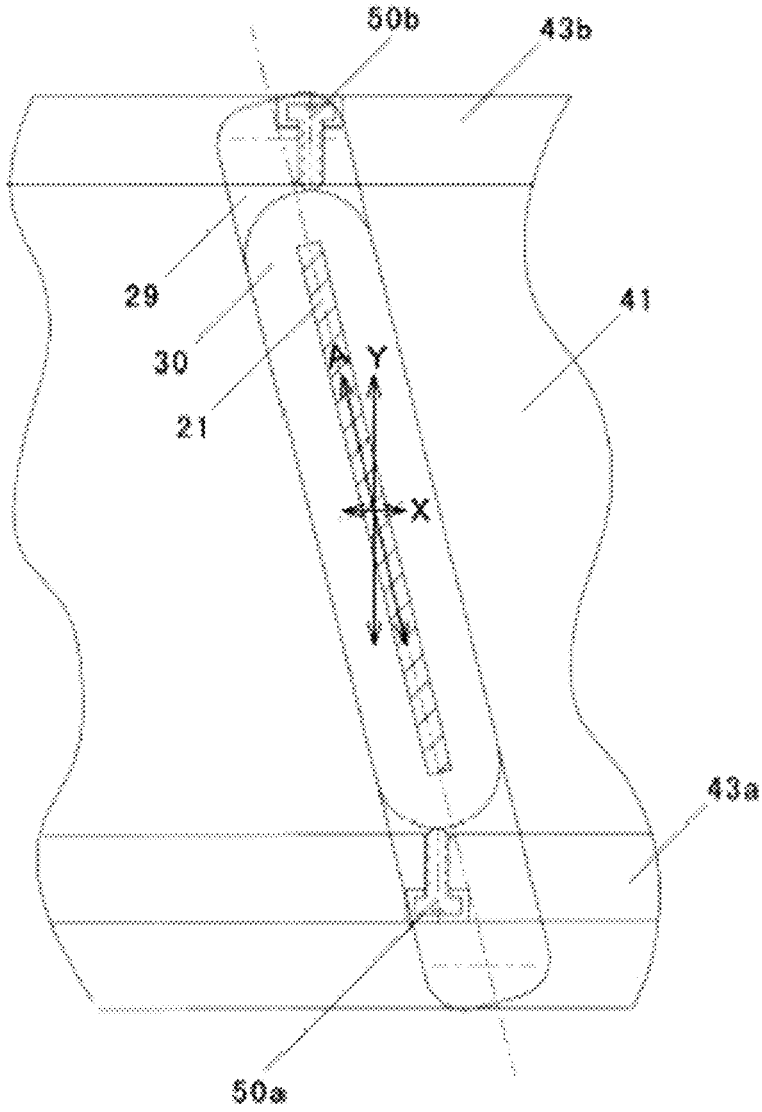

【Figure 6】
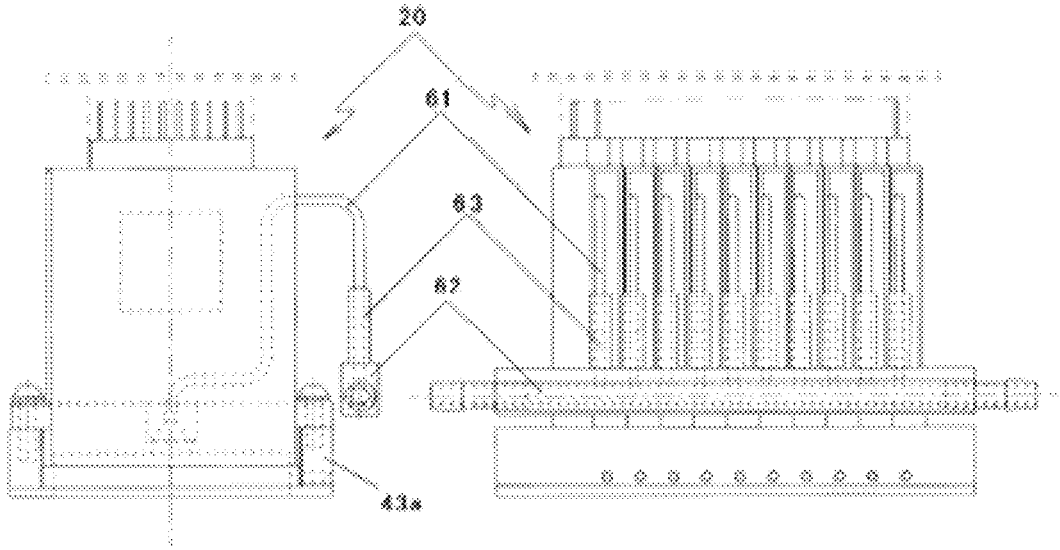
【Figure 7】
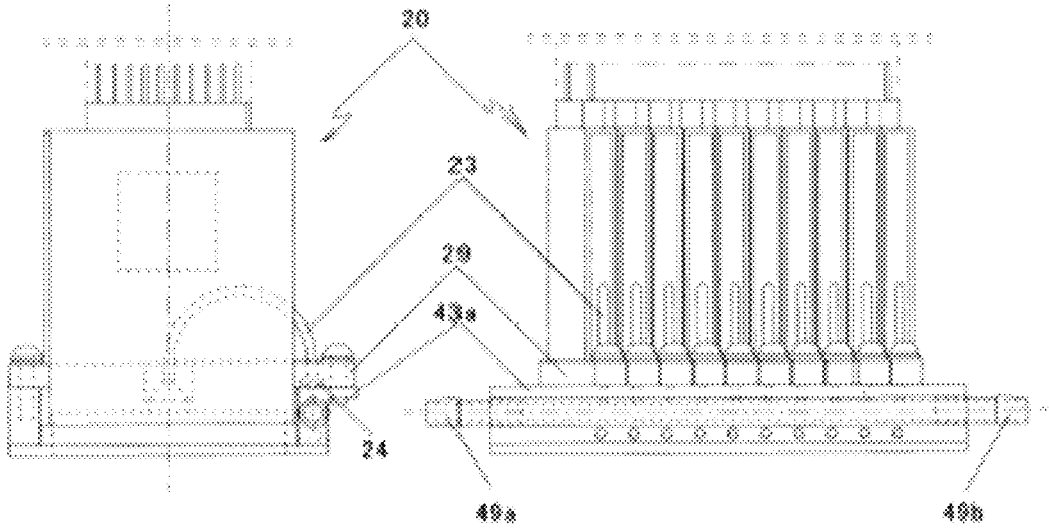

【Figure 8】
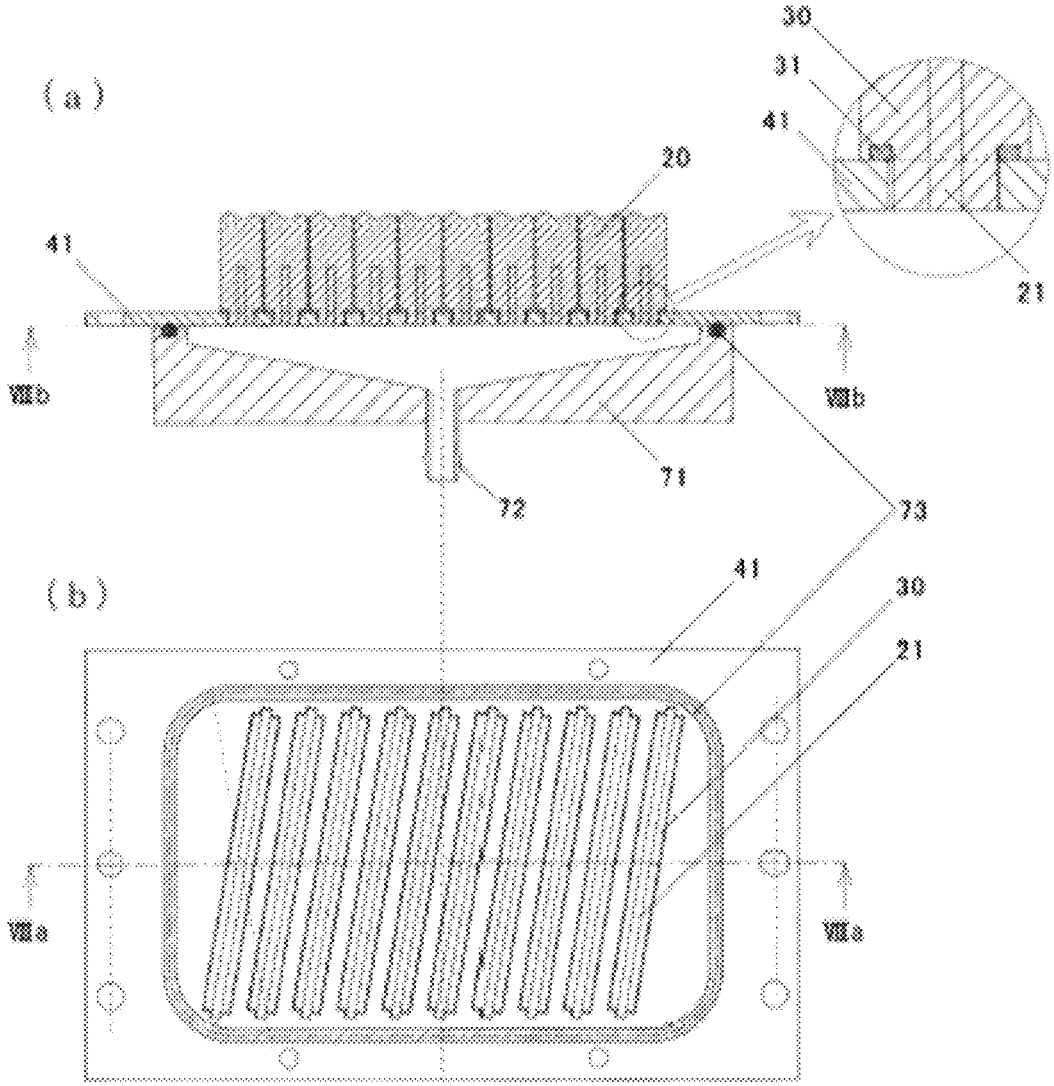

【Figure 9】
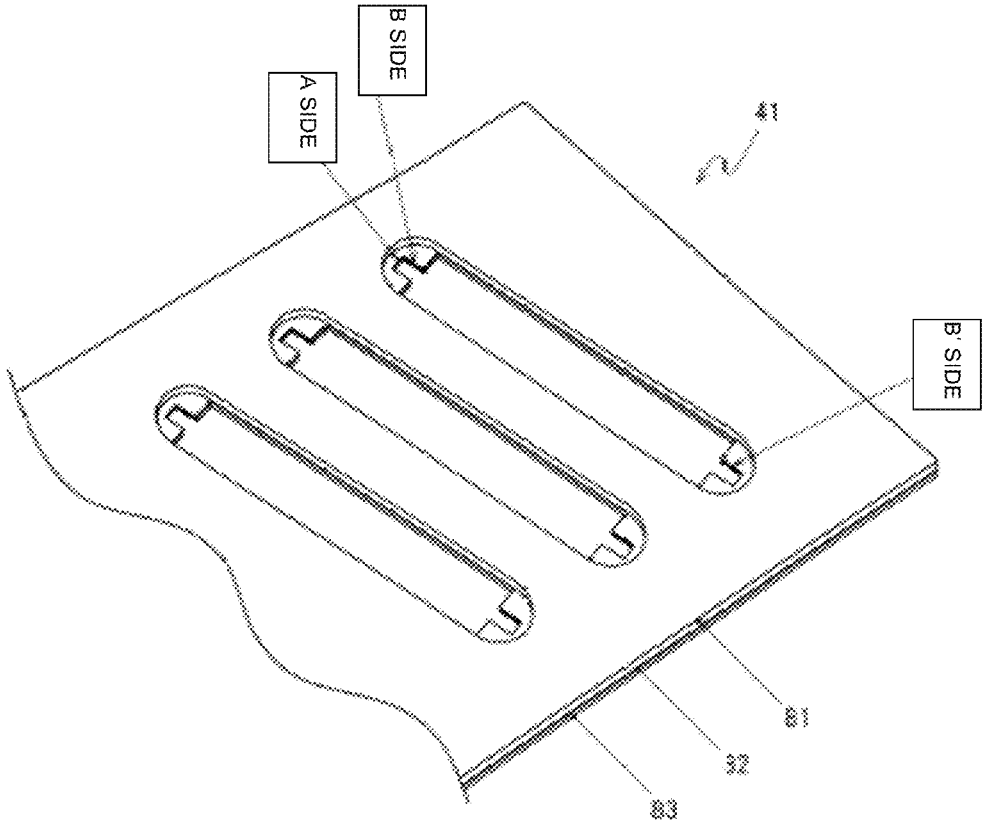

【Figure 10】
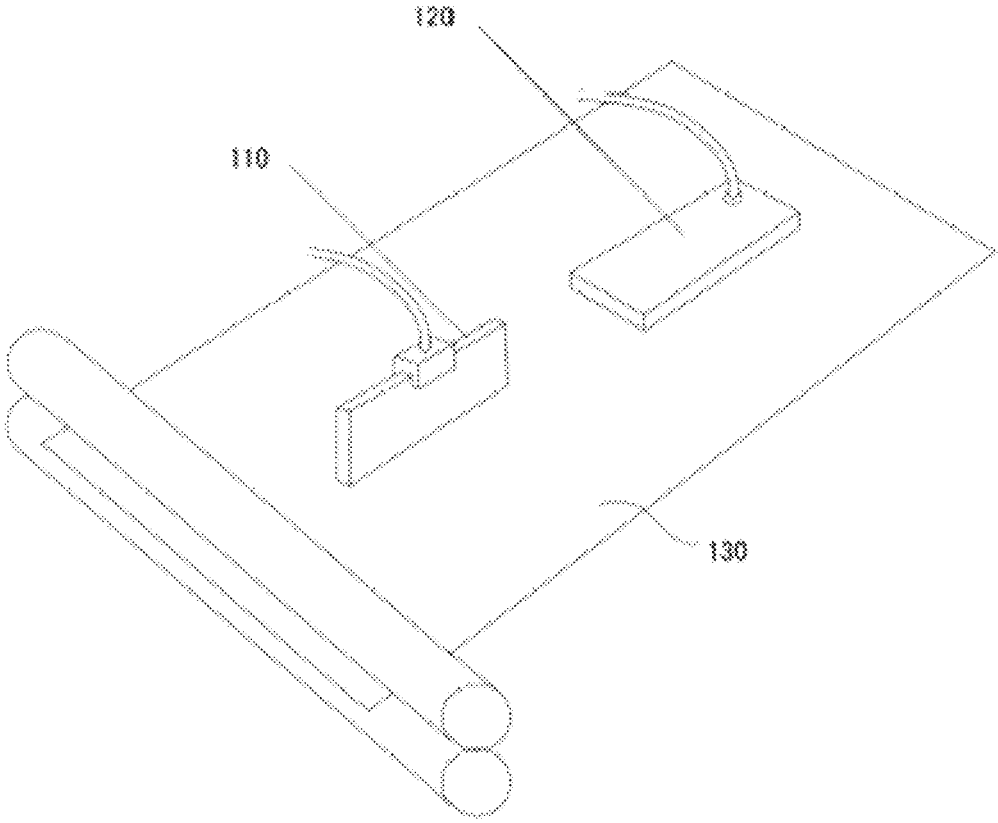

【Figure 11】
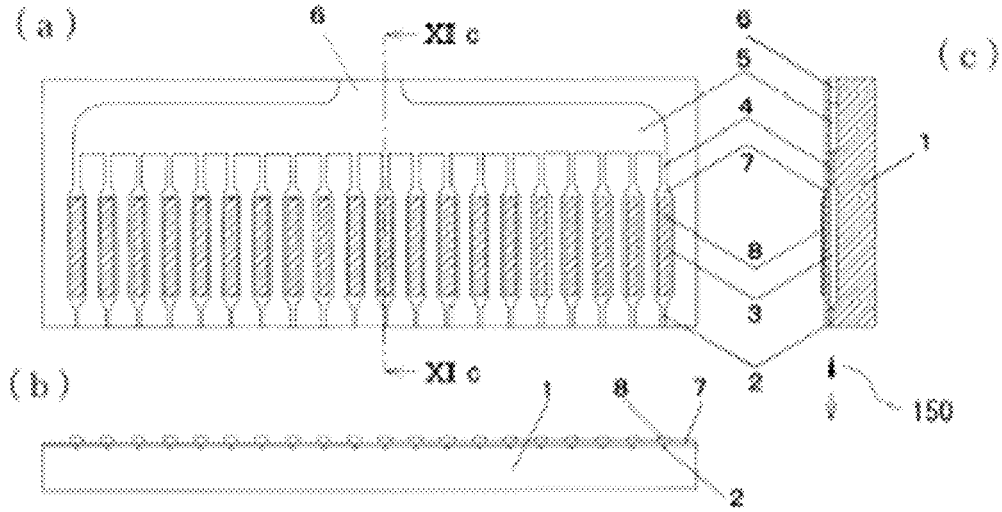
【Figure 12】
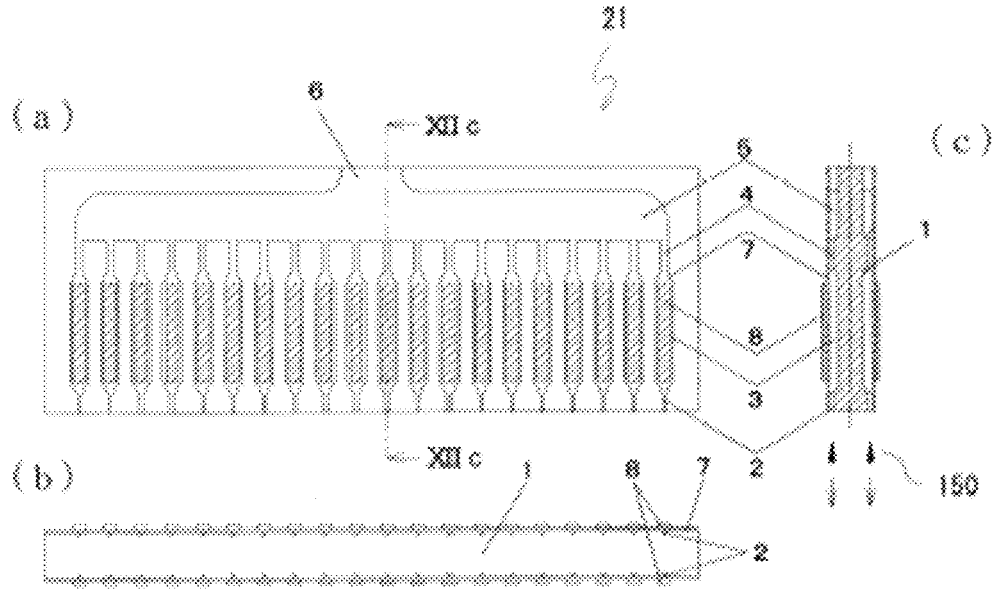

【Figure 13】
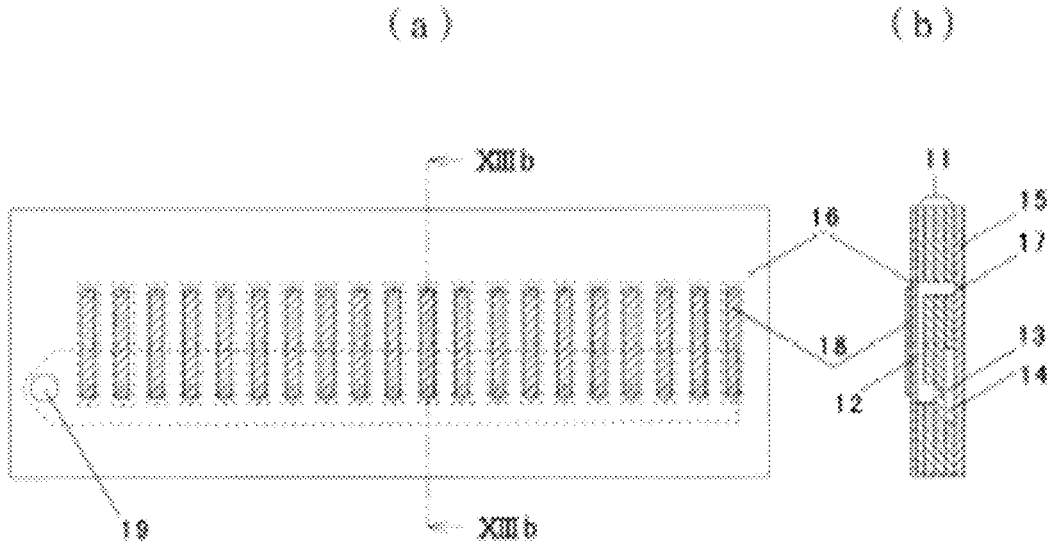

INK JET RECORDING HEAD

FIELD OF TECHNICAL APPLICATION

This invention is related to the inkjet recording head where ink is discharged as small droplets from nozzles to record data on recording media, particularly an inkjet recording head that provides increased recording speed.

BACKGROUND TECHNOLOGY

It is well-known that in conventional inkjet recording ink is sprayed through a minute nozzle onto paper or other recording media to which it adheres to execute the designated recording job. Named after the differences in their discharge mechanisms, this system is further divided into two distinct ink droplet discharge systems (herein referred to as recording heads) that use this method—the thermovalve system and the Kaiser system.

In the thermovalve system, ink instantaneously heated and boiled near the nozzle is discharged. In the thermovalve system, however, the heater component that generates heat has a short life-span, and because calorific (heating) value increases relative to discharge frequency, it is not suited to high-speed continuous recording.

Named after its inventor, in the Kaiser system, the rear part of the nozzle is equipped with an ink compression chamber and a piezoelectric element that functions as the transformable wall of the compression chamber, such that applying voltage to transform the piezoelectric element causes ink discharge. The principle of the recording head in the Kaiser system has already been disclosed in patent document 1 (Published examined application no. 1978-12138, FIGS. 2 and 3) It has few of the drawbacks pointed out in the thermovalve system, and is beneficial to the realization of high-speed and continuous recording.

Due to the advantages of high-speed and continuous recording, the Kaiser system is normally adopted.

There are 2 types of recording heads used in the Kaiser system—the edge shooter recording head and the side shooter recording head. FIG. 10 is a schematic drawing explaining the differences between edge shooter recording head 110 and side shooter recording head 120. In the edge shooter, the substrate is used vertically, while the side shooter uses it horizontally. For this reason, the edge shooter projected area on paper or other recording media 130 is significantly smaller than that of the side shooter.

The following is a detailed explanation of edge shooter recording head and the side shooter recording head.

The edge shooter recording head shall be explained first. FIG. 11 is a structural diagram of the single-sided edge shooter recording head, where 11(*a*) is a front elevational view, 11(*b*) is a bottom view and 11(*c*) is a cross-sectional view of XIc-XIc.

The single-sided type edge shooter recording head is equipped with flow channel substrate 1, nozzle 2, ink compression chamber 3, aperture flow channel 4, ink tank 5, ink supply port 6, diaphragm 7 and piezoelectric element 8.

One side (the top side in 11(*b*)) of Flow channel substrate 1, a substrate made from silicon wafer, glass or metal plate, etc, is processed using etching or other mechanical methods to produce canaliform structures for nozzle 2, ink compression chamber 3, aperture flow channel 4, etc and ink tank 5 that connects them all. In addition, ink tank 5 is linked via ink supply port 6 to the ink supply well not shown in the diagram. In the edge shooter recording head where, after covering and integrating diaphragm 7 with the surface of the processed side of flow channel substrate 1, electric device conversion element piezoelectric element 8 is bonded to the surface of the side opposite diaphragm 7 at a location corresponding to that of ink compression chamber 3. Nozzle 2 is mounted to the edge of the substrate that corresponds to the direction perpendicular to the direction of distortion caused by piezoelectric element in ink compression chamber 3. The device is equipped with 20 units of nozzle 2.

When operating the single-sided edge shooter recording head, applying pulse form voltage to piezoelectric element 8 causes diaphragm 7 to distort, and when the distortion is recognized by ink compression chamber 3, the volume of ink compression 3 is rapidly reduced and ink droplets 150 amounting to a portion of the ink equivalent to this reduced volume are discharged from nozzle 2 to adhere to and execute the designated print job on the recording media not shown.

FIG. 12 is a structural diagram of the double-sided edge shooter recording head, where 12(*a*) is a front elevational view, 12(*b*) is a bottom view and 12(*c*) is a cross-sectional view of XIIc-XIIc.

In comparison to the single-sided edge shooter recording head in which flow channels are formed only on one side of flow channel substrate 1, the double-sided edge shooter recording head shown in FIG. 12 is equipped with flow channels formed in the same way on both sides (the top and bottom surfaces in 12(*b*)) of flow channel substrate 1. As a result, 40 units, 2 times the normal 20 nozzle(s) 2, can be formed on the same substrate.

Next is an explanation of the side shooter recording head. FIG. 13 is a structural diagram of the side-shooter type recording head, where 13(*a*) is a front elevational view, and 13(*b*) is a cross-sectional view of XIIIb-XIIIb.

The side shooter recording head is equipped with cavity plate 11, ink compression chamber 12, aperture flow channel 13, ink tank 14, nozzle plate 15, diaphragm 16, nozzle 17, piezoelectric element 18, and ink supply port 19.

Cavity plate 11 is a metal, glass, ceramic, plastic, etc substrate that is equipped with ink compression chamber 12, aperture flow channel 13, and ink tank 14 formed using etching or other mechanical processing methods, and on each side of which nozzle plate 15 and diaphragm 16 are layered and integrated using an adhesive, diffusion bonding, or other method.

Ink flow channel 14 is common to the multiple ink compression chambers 12 formed on cavity plate 11 and extends to both sides along these ink compression chambers 12. Each ink compression chamber 12 is connected by aperture flow channel 13 to ink supply channel 14. In addition, one end of ink supply channel 14 is connected to ink supply port 19. Nozzle plate 15 is equipped with nozzle 17 such that it is formed perpendicularly to ink compression chamber 12 to which it communicates.

Furthermore, electric device conversion element piezoelectric element 18 is adhered or bonded to the outer periphery of diaphragm 16 that corresponds to ink compression chamber 12. This kind of side shooter recording head is positioned in the same direction as the displacement direction of piezoelectric element 18 and diaphragm 16. The device is equipped with 20 units of nozzle 17.

When operating the side shooter recording head, applying pulse-form voltage to piezoelectric element 18 displaces diaphragm 16 inward, thus decreasing the volume inside ink compression chamber 12. As a result of this, the amount of ink that corresponds to the displaced volume is discharged from nozzle 17 to record job data on the recording media not shown.

The following is a comparison of the recording density of the edge shooter recording head and the side shooter recording head. Here, we will consider the issue of mount density as a factor when increasing the number of nozzles; in other words, the number of nozzles that can be formed on the surface of a single substrate.

In order to attain the same discharge performance (discharge amount, discharge speed, discharge frequency) for both the edge shooter and the side shooter, recording heads, it is necessary to provide the same level of driving force in each system, but when using piezoelectric elements for both systems, the amount of drive force achievable is basically determined by the surface area of the compression chamber. Since form is determined by the need for air bubble removability and a lead wire extraction method and so on, both head types are generally shaped like rectangular strips. As a result, the surface area of their compression chambers are approximately the same.

Furthermore, as can be seen in FIG. 12, the edge shooter recording head is equipped with head functions on both sides of the head substrate. In comparison to this, the side shooter recording head cannot be configured with components on both sides since its compression and nozzle components are located on different surfaces. For this reason the edge shooter recording head is highly beneficial from the perspective of enhancement of nozzle density. Therefore, when attempting to increase the number of nozzles by lining up multiple nozzles on the head substrate, the edge shooter type provides a more highly advantageous structure than the side shooter type.

Most current inkjet recording device recording heads employ a method of scanning (sweeping across) the recording media widthwise. The reason that this type of scanning is necessary is that the head is equipped with a limited number of nozzles and cannot cover the entire width of the recording media at once. For example, to record data to a sheet of A4 paper (width 210 mm) at a dot recording density of 600 dpi with a fixed head would require a recording head equipped with 4961 (=210÷25.4×600) nozzles aligned at intervals of 1/600 inch (=42.33 μm).

It is extremely difficult to produce a single sheet of substrate mounted with a recording head equipped with such as large amount of nozzles. To realize this, a semiconductor manufacturing method appropriate for precision processing is generally used. However, to this end, it is necessary to use a material of proportionally greater size than the 210 mm-wide recording width, such as a 300 mm-diameter silicon wafer, but the equipment needed to handle such large diameter wafers is terribly expensive, and from the perspective of yield, not very practical.

Therefore, the method of mounting a single sheet of substrate with several tens to several hundreds of recording heads that can be easily attached to achieve scanning is normally adopted. This head scanning method, however is highly disadvantageous to recording speed since the back and forth traveling of the head requires repeated acceleration and deceleration.

Thus, in order to solve the abovementioned problems, in patent document 2 (Bulletin No. 1996-300645 (FIGS. 1-3)), a long fixed inkjet recording head was disclosed where the number of nozzles desirable from the manufacturing perspective were configured on a single sheet of substrate in the edge shooter type configuration, after which this structure was aligned in the number required so as to eliminate the need to scan the head.

The configuration of on-demand inkjet recording devices is simple, but although it uses ink which is inexpensive and suited to colorization as a means of recording, its slow recording speed has set back its dissemination into the industrial fields that require high-speed printing.

In order to achieve greatly improved recording speed, it is desirable to employ a system in which the width of the target recording media is covered entirely by the recording head such that the recording head remains stationary while the recording media sweeps. However, because the number of nozzles on such a long recording head becomes so great, the density of nozzles above the surface of the recording media must be high and the head must be of a configuration that provides good production yield.

In the abovementioned patent document 2's inkjet recording head, all components except the nozzles are configured on separate substrates, but all of the nozzles are established on a single plate. Furthermore, individual substrates and the nozzle plate are integrated using an adhesive bonding agent, etc, so that if even one of the nozzles malfunctions, the entire length of the inkjet recording head must be replaced. Therefore, this structure presents the disadvantage of a highly unfavorable relationship between production yield and demand.

In response to this issue, this invention was developed in consideration of the abovementioned problems for the purpose of providing a long inkjet recording head that is easy to manufacture and that can realize high-speed continuous recording.

DISCLOSURE OF THE INVENTION

In order to solve the abovementioned problem, the inkjet recording head related to the invention in Claim 1 is equipped with multiple edge shooter type head units with a head chip formed such that the nozzle discharge surfaces of the nozzles that discharge ink are distributed in a straight line at regular intervals in a continuous array, the positioning plate that fixes the positions of multiple head units are distributed in rows that slope with respect to the line array direction of the multiple head units, and the nozzle intervals in the direction of 2 nozzle line arrays adjacent to the nozzle injection surfaces form the slope angle that corresponds to a given resolution.

The edge shooter head pitch, for example, is set such that multiple microscopic canals are formed at a specified interval on the flow channel substrate so that they each become ink flow channels as a result of the bonding or adhering of a diaphragm to the flow channel substrate, and piezoelectric elements are adhered or bonded to the diaphragms that correspond to each of the ink flow channel compression chambers so that ink is discharged from each of the nozzles formed perpendicularly to the compression direction of the compression chambers to which they communicate.

In addition, the head unit is configured such that the ink supply components and piezoelectric element drive circuit components that correspond to this head chip are integrated to form single units.

Furthermore, the nozzle interval of the line array direction (the direction perpendicular to the paper feed direction) is configured such that the head units that are sloped in such a way that they correspond to a given resolution are distributed parallel to the multiple unit line array direction. To this end, the outer periphery of the head units is established such that they do not obstruct alignment in the given interval.

Through this structure, by lining up head units, a long inkjet recording head can be easily achieved, thereby realizing highly enhanced recording speed in an inkjet recording device mounted with inkjet heads.

Furthermore, this structure offers easy replacement of head units, cost reduction and enhanced maintenance features.

In addition, the inkjet recording head related to the invention in Claim 2 is configured such that in the inkjet recording head described in Claim 1, the positioning plate is equipped with a slit that wedges and pushes the head chip of the head unit in such a fashion that the bonding of the slit datum plane of the positioning plate and the surface of the head unit's head chip allows the position of the head unit to be fixed in relation to the positioning plate.

Although a high precision positioning mechanism is required to align multiple head units in specified positions, position accuracy when aligning multiple head units in a given position is achieved by bonding each of the long and short side surfaces of the head chip forming the nozzle to integrate it with the abovementioned head unit positioning plate datum processed for specified precision. Even if multiple head units are lined up to form a long inkjet recording head, recording media position accuracy for the ink discharged from the nozzles can be sufficiently achieved.

In addition, the inkjet recording head related to the invention in Claim 3 is configured such that the inkjet recording head described in Claims 1 and 2 is equipped with installation screws on both edges of the head unit that are screwed into the positioning plate surface in a perpendicular direction—one screwed in the left (counterclockwise) direction, the other in the right (clockwise) direction, tangent screws that are screwed into the positioning plate surface and turn horizontally to come into contact with the head unit, such that the lengthwise direction of head chip is subjected in one direction to the suppressive force of the tangent screws and the widthwise direction of head chip is subjected in the other direction to the suppressive force generated when the left and right installation screws on both edges of the head unit are tightened, thereby adhering the positioning plate datum to the head chip.

The adhesion bond of the head chip that corresponds to the datum of the positioning plate fixes the specified position of the head unit by applying suppressive force to the lengthwise direction of head chip when tangent screws, etc are rotated at the center of the rotation axis of the parallel direction with relation to the surface of the positioning plate, and by applying suppressive force to the widthwise direction of head pitch when the installation screws on the left and right edges of the head unit are tightened by rotating at the center of the rotation axis of the vertical direction with relation to the surface of the positioning plate. The tangent mechanism of the screws, etc attached to the positioning plates ensures the specified positional accuracy of the X direction (perpendicular to the paper feed direction) by diagonally (the lengthwise direction) sliding the head unit. Y direction (paper feed direction) position accuracy is made possible by adjusting the timing of ink discharge with relation to the paper feed distance, thus realizing the position accuracy of the X, Y direction.

Furthermore, the inkjet recording head related to the invention described in Claim 4 is the inkjet recording head described in one of the claims from Claim 1 to Claim 3 equipped with a beam comprising the structural component that stretches across the positioning plate and is arrayed with and holds multiple rows of head units.

By employing this beam as a structural component, it is possible to use a thin positioning plate which is easy to process and can provide greater processing precision, and it becomes easier to form on the positioning plate the slit which provides highly precise positioning.

Also, the inkjet recording head related to the invention described in Claim 5 is the inkjet recording head described in Claim 4 equipped with ink flow channels that supply ink to the head unit and are formed by covering the canals on the beam, or an ink flow channel formed using piping laid in the canals on the beam.

Ink flow channels for supplying ink to the head unit are formed on the part of the beam comprising the structural component that is arrayed with and holds multiple rows of head units on the positioning plate. These flow channels are established in the canals on the structural component beam such that these canals are covered, or pipe is laid inside the canals to form the flow channels.

This structure makes it possible to supply ink to the head unit using as little space as possible and to miniaturize the inkjet recording head.

Furthermore, the inkjet recording head related to the invention described in Claim 6 is the inkjet recording head described in Claim 5 equipped with an ink source that supplies ink from both ends of the ink flow channel.

Since ink is supplied from both ends of the ink flow channel, the ink needed for high speed printing can be supplied sufficiently and speedily.

Furthermore, the inkjet recording head related to the invention described in Claim 7 is the inkjet recording head described in one of the claims from Claim 1 to Claim 6 equipped with a sealant that is inserted to ensure an airtight seal between the head units and the positioning plate.

The sealant (O ring or packing) is inserted between the multiple rows of head units and the positioning plate to achieve an airtight seal between the abovementioned head units and the positioning plate.

An external suction mechanism covers the nozzle injection surface of the head unit, sucking on the nozzle and guiding ink to the ink flow channel, thereby filling the head unit with ink and executing recovery operations when ink discharge fails.

This structure uses an external suction mechanism to achieve easy suction of ink from the nozzles, thereby contributing to the enhancement of inkjet recording head reliability.

Furthermore, the inkjet recording head related to the invention described in Claim 8 is the inkjet recording head described in one of the Claims from 1 to 7 equipped with a multilayer structure where the abovementioned positioning plate is comprised of a datum formation layer that forms the datum and a reinforcement layer for retention of mechanical strength.

One example of this kind of structure is the multilayer structure where a thin middle plate is used for datum formation and thick top and bottom plates are used for the reinforcement layer such that the middle plate is sandwiched between the top and bottom plates. In this structure, the datum formation layer provides the processing accuracy demanded by the positioning plate, and the reinforcement layer provides the strength needed to prevent the deformation of the positioning plate caused by the force generated during suctioning by the external suction device.

Furthermore, the inkjet recording head related to the invention described in Claim 5 is the inkjet recording head described in one of the Claims from 1 to 8 equipped with an internal electrical drive circuit for activating the piezoelectric element inside the head unit, connectors connected to the electrical drive circuit, and a motherboard where a connector is directly connected to each of the multiple head units arranged in rows.

The electrical drive circuit for the piezoelectric element is internally mounted to the head unit, and the respective head unit is equipped with a power source for the abovementioned electrical drive circuit and a connector for transmitting external signals such that each head unit arranged in multiple rows is directly connected to the motherboard connectors.

Since it is possible in this structure to supply power and a drive signal to multiple head units using as little space as possible, miniaturization of the inkjet recording head and space conservation can be achieved.

With the kind of structure provided by this invention, individual units of the head equipped with limited numbers of nozzles that have already been achieved using current technology can be used to configure a long inkjet recording head mounted with a substantial amount of inkjet recording heads. Therefore, mass production of individual units is possible.

Moreover, replacement of head units can be done with ease, thus improving production yield, providing easy maintenance, and permitting the production of an extremely practical long inkjet recording head.

In addition, due to a three-dimensional structure that makes use of the benefits of edge shooter features, it is possible to realize the production of a long high performance miniaturized head.

As a whole, we have been able to provide an easy to manufacture, long inkjet recording head that offers high speed continuous recording.

BRIEF EXPLANATION OF FIGURES

FIG. 1 is a perspective view of the structure of the optimum embodiment of the inkjet recording head required for implementation of this invention.

FIG. 2 is a structural diagram of the head unit, where 2(*a*) is a front elevational view, 2(*b*) is a two-dimensional view 2(*c*) is a bottom view and 2(*d*) is an lid—lid cross-sectional view.

FIG. 3 is a structural diagram of the positioning plate.

FIG. 4 is a schematic diagram of the inkjet recording head, where 4(*a*) is a IVa-IVa cross-sectional view, 4(*b*) is a IVb-IVb cross-sectional view, and 4(*c*) is a schematic diagram of the nozzle injection surface.

FIG. 5 is a diagram explaining another position precision adjustment mechanism and the principle of error correction.

FIG. 6 is a diagram explaining the ink supply system in conventional technology.

FIG. 7 is a structural view of the optimum embodiment of the inkjet recording head and ink supply system required for implementation of this invention.

FIG. 8 is a structural view of another embodiment of the inkjet recording head, where 8(*a*) is a VIIIa-VIIIa cross-sectional view and 8(*b*) is a VIIIb-VIIIb cross-sectional view.

FIG. 9 is a structural diagram of the multi-layer structure of the positioning plate.

FIG. 10 is schematic drawing explaining the differences between the edge shooter recording head and the side shooter recording head.

FIG. 11 is a structural diagram of the single-sided type edge shooter recording head, where 11(*a*) is a front elevational view, 11(*b*) is a bottom view and 11(*c*) is a XIIc-XIIc cross-sectional view.

FIG. 12 is a structural diagram of the double-sided edge shooter recording head, where 12(*a*) is a front elevational view, 12(*b*) is a bottom view and 12(*c*) is a XIIc-XIIc cross-sectional view.

FIG. 13 is a structural diagram of the side-shooter type recording head, where 13(*a*) is a front elevational view, and 13(*b*) is a XIIIb-XIIIb cross-sectional view.

THE OPTIMAL EMBODIMENT REQUIRED FOR IMPLEMENTATION OF THIS INVENTION

The diagrams provided are used to explain the optimal embodiment required for implementation of this invention.

FIG. 1 is a perspective view showing the structure of the embodiment of the inkjet recording head required for implementation of this invention. Note that in FIG. 1, for the purposes of explanation, the illustration shows the structure with the front side head unit removed. Inkjet recording head 100 is a long-type head, equipped, as described in FIG. 1, with multiple (11 units in this embodiment) head units 20, top holder 29, bottom holders 30, positioning plate 41, beams 43*a* and 43*b*, screw ports 44*a* and 44*b*, mounting screws 45*a* and 45*b*, canal 46, cover 47, bifurcated ports 48, ink supply ports 49*a* and 49*b*, tangent screws 50*a* and motherboard 51.

Of these, head unit 20 that determines resolution shall be explained. FIG. 2 is a structural diagram of the head unit, where 2(*a*) is a front elevational view, 2(*b*) is a two-dimensional view 2(*c*) is a bottom view and 2(*d*) is a IId-IId cross-sectional view. Head unit 20 is equipped with head chip 21, filter 22, pipe 23, O ring 24, drive circuit component 25, drive IC 26, connector 27, mounting port 28, top holder 29, bottom holder 30 and O ring 31.

Head chip 21 plays the role of discharging ink droplets, and is the same as the basic structure of the Kaiser-type double-sided edge shooter recording head shown in FIG. 12 with a greater number of nozzles. As one example of this embodiment, this structure will be explained on the assumption that it is equipped with 64 nozzles (total 128) on each side. In this case, it will be mounted with 128 units each of the nozzles 2, ink compression chambers 3, piezoelectric elements 8, etc described in FIG. 12. In addition, silicon wafer is used as the material for producing this flow channel substrate, and its processing will be performed using the equipment and methods widely used in the semiconductor element manufacturing process.

Therefore, it is easy to achieve the necessary and sufficient several μm order of precision required for nozzle dimensions, inter-nozzle pitch and other measurements. Sufficient accuracy of ±3 μm for substrate surface configuration and nozzle port position dimensions is also achieved.

Filter 22 is established inside the ink supply channel and prevents foreign objects inside the ink from flowing into the head substrate.

Pipe 23 is formed with a straight semicircular shape that allows ink to flow freely in this embodiment and forms this head unit's ink supply port and supply channel.

O Ring 24 is mounted to the end of the ink supply port side of pipe 23 and prevents ink leakage at the junction of bifurcated port 48 (see FIG. 1) that communicates with the main ink pipe (explained later) and pipe 23.

Drive circuit component 25 is a flexible print circuit board mounted with piezoelectric element drive IC 26 and top plated with a thin metallic plate such that one end of the flexible print circuit board is soldered to the piezoelectric element electrode and the other is connected to connector 27.

Top holder 29 and bottom holder 30 are resin mold component structures for finishing head unit 20 after the above-mentioned components have been mounted. Holders are mounted to the top and bottom in order to lead the flexible print circuit board out between them.

In addition, as described in the magnified view, another unique point is that both sides of bottom holder 30 are cut to expose chip 21. As a result of this, as will be explained later, greater precision can be achieved in the positioning of positioning plate 41 and head unit 20. Sealant is poured between the top and bottom holders and other components to prevent ink leakage while integrating the holders. Furthermore, top holder 29 is equipped with mounting port 28 for mounting head unit 20 to other components. Another O ring 31 is mounted to the bottom end of the holder for retention of an airtight seal when head unit 20 is mounted to positioning plate 41.

FIG. 3 is a structural view of the positioning plate. As described in FIG. 1, positioning plate 41 becomes the base upon which each head unit 20 is aligned in a row to form long inkjet recording head 100. Slit 42 on positioning plate 41 is the long opening through which head unit 20 is inserted for positioning.

This positioning plate 41 is processed for the highest precision possible using photoetching, laser processing, electrical discharging machining, or an NC device etc on stainless steel or other metallic plating. Positioning precision of short side datum (side A) and long side datum (side B, side B') of slit 42 is particularly important, and in this embodiment head precision of ±5 μm is maintained.

Note that positioning plate 41 shown in FIG. 3 is designed for configuring an A4-size paper width recording head consisting of 38 head units of recording density 600 dpi and 128 nozzles. Therefore, although slit 42 are aligned at 5.419 mm pitch (=25.4÷600×128 mm) in a lateral line array (the direction perpendicular to the paper feed direction), slit intervals and the number of slits will naturally differ with the recording density of the recording head, recording width, and the number of nozzles on each head unit.

Positioning plate 41 is configured such that multiple head units 20 are distributed in an inclined row array with respect to the line array direction. FIG. 4 is a schematic diagram of the inkjet recording head, where 4(*a*) is a IVa-IVa cross-sectional view, 4(*b*) is a IVb-IVb cross-sectional view, and 4(*c*) is a schematic diagram of the nozzle injection surface. Array configuration is shown in 4(*a*) and 4(*b*). As described in FIG. 4(*c*), when d represents the interval between the 2 nozzles 21*a* adjacent to each other on the straight line of the nozzle injection surface, nozzle interval p=cosθ in the line array direction assumes the inclination angle corresponding to the specified resolution (at 600 dpi, since both sides of head chip 21 are equipped with nozzles, the resolution of each side will be 300 dpi. Therefore, interval p becomes p=1/300 inch (=84.66 μm)). For the sake of reference, even in the case of 2 adjacent head units, nozzle interval becomes p and interval is regular for all nozzles in the line array direction.

In inkjet recording head 100, as described in FIG. 1, multiple head units 20 are mounted to positioning plate 41. Beams 43*a* and 43*b* are fixed to both sides of positioning plate 41. Each of these beams 43*a* and 43*b* are equipped with screw ports 44*a* and 44*b* for mounting head units 20. Note that for reasons explained later, screw port 44*a* is configured for right tread screws and 44*b* for left tread screws.

Screw ports 44*a* and 44*b* are used to mount bottom holder 30 of head unit 20 to beams 43*a* and 43*b* using mounting screws 45*a* and 45*b*.

As shown in FIG. 1, head chips 21 of head units 20 are inserted to slit 42 on positioning plate 41 such that they are perpendicular to the surface of positioning plate 41. Perpendicularity is maintained by tightening screws to adhere the top holder 29 of head unit 20 to beams 43*a* and 43*b*.

Canal 46 is gouged from beam 43*a* and adhered to cover 47 to form the main ink supply pipe. The top of canal 46 is equipped with bifurcated port 48 that correspond to each of the ink supply ports of head units 20 such that ink is supplied to each head unit 20 via canal 46.

Each side of canal 46 is equipped with ink supply ports 49*a* and 49*b*. In addition, beam 43*a* is equipped with tangent screws 50*a* for performing fine adjustment of the positions of head units 20. Furthermore, motherboard 51 is connected to connector 27 on the top of unit head 20 to supply power and electronic signals to each head unit.

Note that FIG. 1 shows the configuration before motherboard 51 is connected.

This embodiment of inkjet recording head 100 is configured in this way.

Now, the most important issue when configuring the long inkjet recording head 100 is the attainment of precision nozzle positioning between each nozzle. To this end this embodiment is equipped with a positioning precision adjustment mechanism. This mechanism is explained below.

Although Inkjet recording head 100 is a long head equipped with multiple head units 20 on its positioning plate, in FIG. 4, since the configuration allowing the realization of accuracy of the specified nozzle position is considered important, in order to facilitate explanation, the figure shows only 2 of the head units and abbreviates all other adjacent head units.

As described in FIG. 4, with head chip 21 and bottom holder 30 inserted into slit 42 on positioning plate 41, the structure is temporarily tightened loosely using mounting screws 45*a* (right tread screw) and 45*b* (left tread screw) (to the point where the spring washers not shown begin to crush such that head unit 20 is able to move without rising up). Next, tangent screws 50*a* in beam 43*a* are used to push bottom holder 30 in the Y direction in FIG. 4(*a*).

Here, what should be noted is that the lengthwise direction of slit 42 is not perpendicular, but diagonal.

As a result, bottom holder 30, which is pressed in the Y direction, receives the component force of the A direction (lengthwise direction) and the B direction (widthwise direction). Since bottom holder 30 is integrated with head chip 21, head chip 21 also receives the force of the A and B directions, and both sides of head chip 21 protruding from bottom holder 30 are pressed to each side of slit 42—the short side datum, side A, and the long side datum, sides B and B'—on positioning plate 41.

Next, loosely tightened mounting screws 45*a* and 45*b* are fully tightened one after the other. At this time, since mounting screw 45*b* uses a left tread, during tightening of 45*b* revolving force is activated in the direction indicated by the arrow in FIG. 4(*a*) with regard to the top holder 29 such that head chip 21 integrated with the top holder is pressed toward the lengthwise datum (sides B and B'). In the same way, when the right tread mounting screws 45*a* are tightened, revolving force is activated in the direction indicated by the arrow in FIG. 4(*a*), such that head chip 21 is pressed toward the lengthwise datum (sides B and B').

As a result, the short side and the long side of head chip 21 can be inserted and fixed to the widthwise datum (side A) and the lengthwise datum (sides B and B'), respectively, easily and without the need for special crafting. Note that the width of the short direction of slit 42 is wider than the width of the part of head chip 21 inserted to the slit, so that adherence to the head substrate's lengthwise datum (B and B') is not obstructed.

If left tread screws are not used for mounting screws 45*b*, gaps would develop regardless of whether another method were used to push and tighten head unit 20 toward the lengthwise datum (side B and B'), and it would be extremely difficult to achieve the adhesion required by this embodiment of the inkjet recording head 100 where the size of gaps is less than several μm.

As a result of assembling the structure such that the short side and the long side of head chip 21 can be inserted and fixed to the widthwise datum (side A) and the lengthwise datum (sides B and B'), respectively, as described above, the accuracy of the mutual positioning of all the nozzles spanning the interval between each head chip 21 is for the most part determined by [the dimensional error between the nozzle and both sides of head chip 21 (the short and long sides)]+[the dimensional error between each datum of the positioning plate]. As described above, these 2 error factors affecting accuracy of the positional relationship can both be enhanced by using photoetching, or a semiconductor manufacturing process where high precision processing is easily achievable.

In addition, perpendicularity with regard to the positioning plate of head unit 20 is achieved by ensuring molding accuracy of top holder 29 and bottom holder 30 and processing precision of beams 43*a* and 43*b*.

"Vertical error of head chip 21" is another positioning error related to ink droplet positioning on the recording media, where, when the height of head chip 21 is more than several mm and the distance between the nozzle injection surface at the tip of the head and the recording media is normally about 1 mm, recording media error is several fractions of the inclination dimension of the tip of the head chip, this error can be limited to several μm since the influential factors of the top holder 29 and bottom holder 30 of each head unit are both molded with uniform dimensions.

From these results, it is evident that regardless of the fact that the long inkjet recording head described in FIG. 1 consists of multiple head units 20, it is easy to attain the precision necessary for realizing an inkjet recording device where the relative positions of all nozzles provide a recording density of 600 dpi.

The following will explain another position precision adjustment mechanism that performs error correction for the removal of the slight errors generated with the positioning method described above. FIG. 5 is an illustration explaining the position precision adjustment mechanism and principle of error correction. This embodiment differs from the structure of the position precision adjustment mechanism shown in FIG. 4, in that beam 43*b* is also equipped with tangent screw 50*b*.

As described in FIG. 5, since head chips 21 are aligned diagonally, both the X and Y positions of the nozzles change when head chips 21 travel along slit 42 in the A direction.

Using this principle, first head chip 21 is moved back and forth in the A direction in order to reduce to the greatest extent possible any error in the X direction of head chips 21. Then, since the remaining Y direction error will become the travel direction of the recording media, correction can be performed easily by controlling the discharge timing of head units 20.

The following shall explain the invention that promotes ink supply efficiency of the long inkjet recording head that consumes large quantities of ink. Here, the problems related to conventional technology are explained. FIG. 6 is a schematic diagram explaining the ink supply system in conventional technology and FIG. 7 is a structural view of the embodiment of the inkjet recording head and ink supply system in this invention.

As described in FIG. 6, in conventional technology, main ink supply pipe 62 is established parallel to the outer side of the body of the inkjet recording head, and main ink supply pipe 62 is equipped with bifurcating pipe coupler 63 for every head unit 20. Each head unit 20 is equipped with an ink supply pipe 61 that is inserted into coupler 63 so that it communicates to the main pipe when head unit 20 is mounted to beam 43*a*.

Although the structure shown in FIG. 6 is that of a black and white printer, a configuration of a color printer consisting of 4 long inkjet recording head units (for CMYK), would require that the space needed for main ink supply pipes 62 be increased accordingly. In addition, the parts that relate to main ink supply pipes 62 must be configured such that multiple couplers 63 are miniaturized and do not cause ink leakage. Moreover, a retention mechanism for main ink supply pipes 62 is required. Furthermore, residual air bubbles accumulate easily as a result of the level differences created at connection points at the front and back of coupler 63. Ink discharge would be disrupted if residual air bubbles flow into the head substrate, requiring abortion of the recording job to perform recovery processing, which is an extremely undesirable state for the inkjet recording head.

In response to this problem, this embodiment provides an improved ink supply structure. As described in FIG. 7, in this embodiment, the main ink supply pipe is set inside beam 43*a*, one of the 2 beams—43*a* and 43*b*—that are a part of long inkjet recording head 100. In other words, canals are dug out of the beams and covered to form the ink supply channel.

Although beam 43*a* is a component designed to maintain the strength of the lengthwise direction of the long inkjet recording head 100, the only load applied to beam 43*a* is the weight of head unit 20, and from the perspective of the shape and dimensions of 43*a*, it is extremely lightweight and is more than able to meet strength requirements. Therefore, creating a canal for the main ink supply pipe does not adversely affect structural strength in the least. In this example of embodiment 3 mm canals are created in the 5 mm-wide beam 43*a*, but this is not problematic. The 5 mm width of beam 43*a* was originally deemed the width necessary for mounting head units 20. The top of these canals is equipped with enough vertical ports for bifurcated pipes to accommodate the given number of head units Head unit 20 is equipped with ink supply pipe 23 which is embedded in top holder 29. When top holder 29 is mounted to beam 43*a*, the tip of pipe 23 touches the top of beam 43*a*.

Bifurcated port 48 described above in FIG. 1 is created at the exact point where pipe 23 and beam 43*a* come into contact. The bore diameter of pipe 23 is the same dimensions as bifurcated port 48 in FIG. 1.

The point where pipe 23 and beam 43*a* come into contact is equipped with O ring 24, such that by simply fixing holder 29 to beam 43*a*, pipe 23 and bifurcated port 48 of beam 43*a* merge without ink leakage. In this way an extremely simple structure has been developed in this embodiment consisting of only a small amount of components that can be easily assembled and requiring a small amount of space for its ink supply system, and that contains few components that retain air bubbles, thus providing a highly desirous structure for the ink supply system of the long inkjet recording head.

Note that although the flow volume of the main ink pipe naturally increases relative to the number of head unit 20, in order to make the cross-sectional area of the canals in the beam larger than the speciifed amount, it would be necessary to make the beam thicker, which would not be advantageous in a product such as this that requires miniaturization. In order to avoid such a situation to the greatest extent possible, when the number of head units 20 becomes excessively large, this invention is equipped with an ink source (not shown) that is connected via ink supply ports 49*a* and 49*b* formed on both sides of beam 43*a*. Since ink is supplied in abundance from both sides in this way, the cross-sectional area of the canals can be reduced by half. In this embodiment, for example, at a resolution of 600 dpi and ink discharge frequency of 30 KHz, when cross-sectional area of the canal is 10 mm, ink is supplied from one side up to the first 24 units, then from both sides from the $25^{th}$ unit onward.

Furthermore, although it was explained that the canals formed on the beams would become the ink flow channels, the pipes embedded inside the canals can also be used as the ink flow channels. When using these pipes as the ink flow channels, covers can be selected and used arbitrarily as deemed appropriate.

Also, in the inkjet recording head, only after assembly of the head has been completed is filling each of the areas of the head with ink (the process generally referred to as initial filling) necessary. At this time, since retention of even the smallest amount of air bubbles in areas that are normally filled with ink causes discharge failure, the nozzles are vacuum suctioned to perform ink fill. In addition, this suction process is also necessary as a recovery method when long-term storage or unforeseen accidents permit the intrusion of air bubbles that cause faulty discharge.

For this purpose, in the past, suction was executed by placing a suction cap that communicated to a vacuum pump over the tip of the nozzles on every head unit. However, in this proposal for a long head, since the number of head units used increases, requiring every head to perform suction would take too much time and be impractical. In addition, the mechanism for achieving such a process would be complicated. In answer to this problem, in this invention, all units constituting the long head perform suction and filling at the same time.

FIG. 8 is a structural view of another embodiment of the inkjet recording head, where 8(*a*) is a VIIIa-VIIIa cross-sectional view and 8(*b*) is a VIIIb-VIIIb cross-sectional view. Multiple units (10 units in this embodiment) of head unit 20 are arrayed in rows on positioning plate 41 to form long inkjet recording head 100. As described in FIG. 8(*a*), with regard to this inkjet recording head 100, suction cap 71, a concrete example of one means for achieving suction, performs suctioning where it comes into contact with the bottom surface of positioning plate 41. The area between suction cap 71 and positioning plate 41 is equipped with O ring 73 for retention of airtightness. Suction port 72 communicates to a vacuum pump not shown.

What is important here is the retention of airtightness between head unit 20 and positioning plate 41. To that end, in this embodiment, bottom holder 30 of head unit 20 is equipped with O ring 31. As described by the dotted line in FIG. 8(*a*), O ring 31 is located around the periphery of bottom holder 30 to maintain airtightness. Note that although pressure is applied to positioning plate 41 when the inside of suction cap 71 becomes negative pressure against the atmosphere, this can be resolved by selecting the appropriate material and thickness of positioning plate 41. In this embodiment, using 1.5 mm thick stainless material allows the attainment of our objective. By using such common components as O rings 31 and 73 appropriately, we have achieved our objectives of development of a low cost simple structure and an uncomplicated suction mechanism. Note that it is also possible to use a variety of packing materials or sealants in place of O rings 31 and 73.

Note, as well, that because the abovementioned positioning plate 41 fixes the position of head unit 20, it is necessary to ensure the highly precise positioning of datum and the mechanical strength necessary to prevent the kind of distortion that would cause the loss of airtightness due to the application of negative pressure during ink suction.

Though producing high precision positioning plates 41 can be done using etching, laser processing, electrical discharging machining, press working, electroforming, etc, in all of these processing methods, the thinner the positioning plate 41, the easier it is to achieve processing precision. Of these, though etching provides the greatest possible degree of precision processing, in this case, the distance between the masking surface and the etching area increases with the thickness of positioning plate 41, thereby affecting side etching and reducing precision. Therefore, though it is preferable that positioning plate 41 be thin, at a thickness of less than 1 mm, negative pressure during ink suction causes positioning plate 41 to distort, thereby making it impossible to maintain airtightness between head unit 20 and positioning plate 41.

For this reason, in this invention, because processing precision and mechanical strength are both sought after, the plate comprising the datum was made as thin as possible, and a reinforcing plate was adhered or bonded to one or both sides of the plate to form position plate 41. FIG. 9 is a structural view of the multi-layer positioning plate 41. As described in FIG. 9, positioning plate 41 is configured with 3 plates—top plate 81, middle plate 82 and bottom plate 83. Middle plate 82 functions as the layer forming the datum, where the short side forms datum A and the long side forms datum B, B', and the 50 μm-thick stainless plate is processed using wet etching maintaining a processing accuracy of several μm. Top plate 81 and bottom plate 83 function as reinforcement layers made from stainless plates that are 1 mm and 0.5 mm thick, respectively, and although they, too, are formed using wet etching, processing precision is slightly less than that of the middle plate due to their thickness.

Therefore, the slits in top plate 81 and bottom plate 83 are slightly wider than that of short side datum A and long side datum B, B' middle plate 82, and since positioning plate 41 is formed by layering and bonding these 3 plates, head chip 20 is inserted so as to come into contact only with the high precision middle plate 82. In addition, as a result of this 3-layer configuration, mechanical strength is greatly enhanced and retention of airtightness during ink suction is ensured. Moreover, it is also possible to use only one of the reinforcing top plate 81 or bottom plate 82, or to create a structure of four or more layers. Note that integration of layers can be achieved using an adhesive as well as diffusion bonding or other bonding methods.

Furthermore, in this embodiment, the electrical system has been simplified in order to make replacement of head unit 20 easier. In other words, as can be seen in the structural view of head unit 20 in FIG. 1, an internal piezoelectric element drive circuit has been installed inside unit head 20 so that the number of head unit 20 interface signals is reduced and, as seen in FIG. 2, the top of head unit 20 is equipped with interface connector 27 such that by using motherboard 51 described in FIG. 1 for a direct connection, both power and interface signals can be supplied, and replacement or addition of individual units is made easier.

In addition, the connector cable has also been simplified.

SUMMARY

The inkjet recording head (100) in this invention is equipped with multiple edge shooter type head units (20) with a head chip formed by nozzle discharge surfaces, positioning plates (41) distributed in parallel rows that slope with respect to the line array direction of the multiple head units (20), where in addition to the distribution of the positioning plates (41) in parallel rows that slope with respect to the line array direction of the multiple head units (20), the nozzle intervals in the line array direction of 2 nozzles (21*a*) adjacent to each other on the straight line of the nozzle injection surfaces form the slope angle that corresponds to the specified resolution.

The invention claimed is:

1. An inkjet recording head comprising:

a plurality of head units arranged in a plurality of line arrays, the head units having a head pitch such that the head units are distributed along regular intervals over a straight line, the head units each having a plurality of nozzles;

a plurality of positioning plates that fix positions of the head units; and, a single pair of beams extending across the positioning plates and holding the plurality of head units, wherein a spacing of the nozzles along the line arrays and a non-perpendicular angle of the line arrays relative to the straight line provide a resolution of the inkjet recording head.

2. The inkjet recording head of claim 1, wherein the positioning plates comprise a slit that wedges and pushes head chips of the head units such that an airtight bonding between the positioning plates and the head chips permits fixing the positions of the head units in relation to the positioning plates.

3. The inkjet recording head of claim 1, further comprising a sealant between the head units and the positioning plates to provide an airtight seal between the head units and the positioning plates.

4. The inkjet recording head of claim 1, wherein the positioning plates comprise a multiple-layer structure including a datum formation layer that forms a datum surface and a reinforcement layer to provide mechanical strength to the positioning plates.

5. The inkjet recording head of claim 1, wherein the head units comprise piezoelectric elements, and the inkjet recording head further comprises:

an internal electrical drive circuit for activating the piezoelectric elements;

a plurality of connectors connected to the internal electrical drive circuit; and, a motherboard having a connector directly connected to each head unit.

6. An inkjet recording head comprising:

a plurality of head units arranged in a plurality of line arrays, the head units having a head pitch such that the head units are distributed along regular intervals over a straight line, the head units each having a plurality of nozzles;

a plurality of positioning plates that fix positions of the head units;

a plurality of first screws positioned towards first sides of the head units, the first screws screwed counter-clockwise into the positioning plates in a vertical direction;

a plurality of second screws positioned towards second sides of the head units, the second sides opposite the first sides, the second screws are screwed clockwise into the positioning plates in the vertical direction;

a plurality of third screws screwed into the positioning plates in a horizontal direction and in contact with the head units, wherein a spacing of the nozzles along the line arrays and a non-perpendicular angle of the line arrays relative to the straight line provide a resolution of the inkjet recording head, wherein a lengthwise direction of the head pitch of the head units is subjected to a suppressive force of the third screws and a widthwise direction of the head pitch of the head units is subjected to suppressive force of the first screws and the second screws.

7. An inkjet recording head comprising:

a plurality of head units arranged in a plurality of line arrays, the head units having a head pitch such that the head units are distributed along regular intervals over a straight line, the head units each having a plurality of nozzles;

a plurality of positioning plates that fix positions of the head units;

a beam extending across the positioning plates and holding the plurality of head units, the beam comprising a plurality of canals; and, ink flow channels covering the canals, wherein a spacing of the nozzles along the line arrays and a non-perpendicular angle of the line arrays relative to the straight line provide a resolution of the inkjet recording head.

8. The inkjet recording head of claim 7, further comprising an ink source to supply ink from both first sides and second sides of the ink flow channels.

* * * * *